US005884498A

United States Patent [19]

Kishimoto et al.

[11] Patent Number: 5,884,498

[45] Date of Patent: Mar. 23, 1999

[54] TURBOREFRIGERATOR

[75] Inventors: Akio Kishimoto; Kenji Ueda; Zenichi Yoshida, all of Takasago, Japan

[73] Assignee: Mitsubishi Heavy Industries, Ltd., Tokyo, Japan

[21] Appl. No.: 956,827

[22] Filed: Oct. 23, 1997

[30] Foreign Application Priority Data

Oct. 25, 1996 [JP] Japan ..... 8-299894

[51] Int. Cl.[6] ..... F25B 49/00

[52] U.S. Cl. ..... 62/228.1; 62/172; 62/402

[58] Field of Search ..... 62/86, 172, 402, 62/228.1

[56] References Cited

U.S. PATENT DOCUMENTS 4,734,628 3/1988 Bench et al. ..... 62/228.1

5,176,007 1/1993 Komatsu et al. ..... 62/228.1

*Primary Examiner*—Ronald Capossela

*Attorney, Agent, or Firm*—Alston & Bird LLP

[57] ABSTRACT

A turborefrigerator in which a coolant discharged from a turbocompressor is condensed in a condenser by dissipating heat to a cooling medium and is then reduced by a throttling mechanism, and thereafter, the coolant evaporates by absorbing heat from a cooled medium in an evaporator and is circulated to the turbocompressor. The present invention simplifies the configuration of such a turborefrigerator, so that the size, weight and cost thereof are reduced. Moreover, the present invention enhances the coefficient of performance thereof and prevents lubricating oil and a cooling medium from blending with each other to cause inconveniences. Thus, the turborefrigerator of the present invention is further provided with an inverter motor whose output shaft directly connected to an impeller of the turbocompressor is supported by a bearing lubricated by a liquid refrigerant, and with a control unit adapted to control both of a suction vane, which is provided in the turbocompressor, and the inverter motor by associating said suction vane and the inverter motor with each other.

20 Claims, 24 Drawing Sheets

TURBOREFRIGERATOR

FIELD OF THE INVENTION

The present invention relates to a turborefrigerator. FIGS. 12(A) and 12(B) show an example of a conventional turborefrigerator.

BACKGROUND OF THE INVENTION

When a turbocompressor 1 is operated, a high-pressure gaseous refrigerant discharged from this turbocompressor 1 is fed to a condenser 2 wherein the gaseous refrigerant is condensed and liquefied by dissipating heat to a cooling medium, such as cooling water, flowing and passing through a heat transfer tube 3, as illustrated in FIG. 12(A).

Then, this liquid refrigerant flows into an intercooler 4 in which the pressure of the liquid refrigerant is throttled or reduced to an intermediate pressure in a high-pressure-side throttling (or pressure reducing) mechanism 24. Thus, a part of the liquid refrigerant evaporates. Further, liquid drops are separated by an eliminator 26. Thereafter, the vapor is sucked into a high-stage-side impeller 8 of the turbocompressor 1.

The remaining liquid refrigerant is cooled owing to latent heat of the vaporization. Thereafter, the remaining liquid refrigerant is reduced by a low-pressure-side pressure reducing mechanism 25. Thus, the flow rate of the liquid refrigerant is regulated. Simultaneously, adiabatic expansion thereof occurs, so that a low-pressure gas-liquid two-phase flow thereof is obtained.

Then, this refrigerant enters an evaporator 5 wherein this medium evaporates and vaporizes by absorbing heat from cooled media such as brine and cooling water flowing and passing through a heat transfer tube 6 and is changed into a low-pressure gaseous refrigerant. This low-pressure gaseous refrigerant is sucked again into the turbocompressor 1.

Centrifugal impellers 7 and 8 of the turbocompressor 1 are fixedly mounted on an end portion of the rotary shaft 9 in such a manner as to be spaced in the direction of the shaft, and are enclosed in a hermetic housing 10.

Further, a pinion 11 is fixedly mounted on the other end portion of this rotary shaft 9. In a gear chamber 19, the pinion 11 engages with a gear (or wheel) 12 which is fixedly mounted on an output shaft 14 of an induction motor 13.

Rotary shaft 9 of the turbocompressor 1 is supported by bearings 15 and 16 in the gear chamber 19, while the output shaft 14 of the induction motor 13 is supported by bearings 17 and 18.

Oil reservoir 20 is formed in the bottom portion of the gear chamber 19. Lubricating oil stored in the oil reservoir 20 is extracted by an oil pump 21 to an oil cooler 22 wherein the lubricating oil is cooled by allowing the lubricating oil and the cooling medium, which has flowed through the heat transfer tube 23, to perform heat exchange therebetween. Further, after foreign materials are removed from the lubricating oil by a filter 27, the cooled lubricating oil is supplied to and lubricates the pinion 11, the gear 12 and the bearings 15, 16, 17 and 18. Thereafter, the lubricating oil returns to the oil reservoir 20.

Referring now to FIG. 12(B), there is shown Mollier chart (or diagram) of this cooling cycle.

Gaseous refrigerant sucked into the turbocompressor 1 when being in a state A is then brought into a state B by being compressed by means of a low-stage-side impeller 7. Subsequently, the gaseous refrigerant is sucked into the high-stage-side impeller 8 when being in a state C, and is then put into a state D by being compressed.

This gaseous refrigerant is brought into a state E by being cooled by the use of a condenser 2. Subsequently, this refrigerant gas becomes a saturated liquid refrigerant, which is in a state F, by being condensed. This saturated liquid refrigerant is then put into a state G by being reduced by means of the high-pressure-side pressure reducing mechanism 24 of the intercooler 4. Further, a part of this saturated cooling medium evaporates and is brought in a state C and is then sucked into the high-stage-side impeller 8.

The rest of this liquid refrigerant is put into a state H and is further brought into a state I by being reduced by means of the low-pressure-side pressure reducing mechanism 25. This cooling medium becomes put into the state A by evaporating in the evaporator 5, and is then sucked into the turbocompressor 1.

Incidentally, in Mollier chart, reference character J designates a saturated liquid line; and K a saturated vapor line.

However, in the case of the aforementioned conventional turborefrigerator, the rotary shaft 9 of the turbocompressor 1 is supported by bearings 15 and 16. Further, the output shaft 14 of the induction motor 13 is supported by bearing 17 and 18. Furthermore, power of the induction motor 13 is transmitted to the turbocompressor 1 through the gear 12 and the pinion 11. Consequently, the aforesaid conventional turborefrigerator has encountered problems in that the configurations of the turbocompressor 1, a speed-increasing mechanism and the induction motor 13 becomes complex, that not only the dimensions, weight and cost thereof are increased but the mechanical loss thereof is high, and that the coefficient of performance (COP) is low.

Further, the bearings 15, 16, 17 and 18 and the gears 11 and 12 are lubricated by the lubricating oil. Therefore, it is necessary to change the lubricating oil periodically. Moreover, the lubricating oil and the cooling medium cannot be prevented from blending with each other through the rotary shaft 9.

When the temperature and pressure rise, the cooling medium having blended with the lubricating oil evaporates. Thus, there are a fear that the inconveniences, such as the cavitation of the oil pump 21 and the lubrication failure and seizure of the bearings 15, 16, 17 and 18, are caused.

Moreover, when lubricating oil blends with the cooling medium, the heat-transfer-performance of the condenser 2 and the evaporator 5 is degraded. Thus, there is a fear that reduction in the cooling ability, increase in power consumption; abnormal stop of the refrigerator are caused.

OBJECT AND SUMMARY OF THE INVENTION

The present invention is accomplished to solve the aforementioned problems of the conventional refrigerator. The gist of the present invention lies in that, in a turborefrigerator (hereunder sometimes referred to as a first turborefrigerator) of the present invention in which a refrigerant discharged from a turbocompressor is condensed in a condenser by dissipating heat to a cooling medium and is then reduced by a pressure reducing mechanism or a throttling mechanism, and thereafter, the refrigerant evaporates by absorbing heat from a cooled medium in an evaporator, and is circulated to the aforesaid turbocompressor, an output shaft of an inverter motor directly connected to an impeller of the aforementioned turbocompressor is supported by a bearing lubricated by a liquid refrigerant, and in that the aforesaid turborefrigerator is provided with a control unit adapted to control both of a suction vane, which is provided in the aforesaid turbocompressor, and the inverter motor by associating (or linking) the suction vane and the inverter motor with each other.

Another characteristic aspect (corresponding to a second turborefrigerator) of the present invention resides in that a saturated refrigerant extracted from a reservoir of the aforesaid evaporator is supplied to the aforesaid bearing after pressurized by a liquid refrigerant pump.

Another characteristic aspect (corresponding to a third turborefrigerator) of the present invention resides in that the aforesaid turbocompressor is a multistage turbocompressor, that the aforesaid turborefrigerator is provided with an intercooler for cooling a part of the saturated liquid refrigerant condensed by the aforesaid condenser, with the remaining part of the condensed refrigerant evaporating so as to effect this cooling, that the liquid refrigerant cooled by this intercooler is pressurized by a liquid refrigerant pump, and that thereafter the pressurized refrigerant is supplied to the aforesaid bearing.

Another characteristic aspect (corresponding to a fourth turborefrigerator) of the present invention resides in that the saturated liquid refrigerant condensed by the aforesaid condenser is pressurized by the liquid refrigerant pump and that thereafter, the pressurized refrigerant is fed to the aforesaid bearing.

Another characteristic aspect (corresponding to a fifth turborefrigerator) of the present invention resides in that the saturated refrigerant, which is condensed by the aforesaid condenser, is supercooled by a supercooler and that thereafter, the supercooled refrigerant is supplied to the aforesaid bearing.

Another characteristic aspect (corresponding to a sixth turborefrigerator) of the present invention resides in that the saturated liquid refrigerant, which is condensed by the aforesaid condenser, is pressurized by the liquid refrigerant pump and is supercooled by a supercooler and that thereafter, the pressurized and supercooled liquid refrigerant is fed to the aforesaid supercooler.

Another characteristic aspect (corresponding to a seventh turborefrigerator) of the present invention resides in that the aforesaid saturated liquid refrigerant is supercooled by the aforesaid supercooler by causing the aforesaid saturated liquid refrigerant and the aforesaid cooling medium to perform heat exchange therebetween.

Another characteristic aspect (corresponding to a eighth turborefrigerator) of the present invention resides in that the aforesaid saturated liquid refrigerant is supercooled by the aforesaid supercooler by causing the aforesaid saturated liquid refrigerant and the aforesaid cooled medium to perform heat exchange therebetween.

Another characteristic aspect (corresponding to a ninth turborefrigerator) of the present invention resides in that the aforesaid supercooler comprises a heat transfer tube provided in the aforesaid evaporator and that the aforementioned saturated liquid refrigerant flowing and passing through this heat transfer tube is supercooled by utilizing latent heat of vaporization of a refrigerant outside the tube.

Another characteristic aspect (corresponding to a tenth turborefrigerator) of the present invention resides in that the aforesaid supercooler is installed upstream from the aforesaid evaporator and supercools the aforementioned saturated liquid refrigerant by utilizing latent heat of vaporization of a refrigerant having flowed through the aforesaid throttling mechanism.

Another characteristic aspect (corresponding to a eleventh turborefrigerator) of the present invention resides in that the aforesaid supercooler is connected in parallel with the aforesaid pressure reducing mechanism and supercools the aforementioned saturated liquid refrigerant by utilizing latent heat of vaporization of a refrigerant having branched off therefrom and flowed through a throttling mechanism of small capacity.

Another characteristic aspect (corresponding to a twelfth turborefrigerator) of the present invention resides in that the aforesaid turbocompressor is a multistage turbocompressor, that the aforesaid turborefrigerator is provided with an intercooler having a high-pressure-side throttling mechanism and a low-pressure-side throttling mechanism, that the aforesaid turborefrigerator is provided with a bypass path for introducing a part of the aforementioned saturated liquid refrigerant into an upstream side of the aforesaid low-pressure-side throttling mechanism of the aforementioned intercooler, that the aforesaid supercooler is inserted into the aforesaid bypass path and supercools the aforementioned saturated liquid refrigerant by utilizing latent heat of vaporization of an intermediate-pressure refrigerant having branched off therefrom and flowed through a throttling mechanism of small capacity.

Further, still another characteristic aspect (corresponding to a thirteenth turborefrigerator) of the present invention resides in that the aforesaid turborefrigerator is provided with another small refrigerating (or refrigeration) cycle from which heat is absorbed in the aforesaid evaporator and that the aforesaid supercooler is constituted by an evaporator of the aforesaid small refrigerating cycle.

In the case of the aforesaid first turborefrigerator of the present invention, the turbocompressor is driven by the inverter motor. Thus, the turbocompressor can be rotated at a high speed by increasing an inverter frequency.

Therefore, the first turborefrigerator of the present invention does not require a speed increasing mechanism, differently from the conventional turborefrigerator. Consequently, the structure of a turborefrigerator is simplified. Moreover, the dimensions, weight and cost thereof can be reduced. Furthermore, the mechanical loss thereof can be decreased, so that COP thereof can be enhanced.

Further, a suction vane is provided in the first turborefrigerator of the present invention. Furthermore, the turbocompressor is controlled by a control unit by associating the opening of this suction vane (namely, the quantity of intake gas) with the number of revolution of the inverter motor. Thus, the efficiency of the turbocompressor can be increased. Consequently, COP of the turborefrigerator can be enhanced.

Moreover, the impeller of the turbocompressor is directly connected to the output shaft of the inverter motor. Thus, these elements can be contained in a single hermetic housing. Additionally, the structure of the turborefrigerator can be simplified in this respect. Consequently, the size, weight and cost thereof can be decreased. Further, the mechanical loss thereof can be reduced.

Furthermore, the output shaft of the inverter motor is supported by the bearing lubricated by the liquid refrigerant. Thus, there is no need for using the lubricating oil. Therefore, the periodic replacement of the lubricating oil is unnecessary. Further, the lubricating oil and the refrigerant do not blend with each other. Thus, the cavitation of the oil pump, the lubrication failure of the bearing and the deterioration in the heat transfer performance of each of the condenser and the evaporator can be prevented.

In the case of the aforesaid second turborefrigerator of the present invention, the saturated liquid refrigerant, which is extracted from the reservoir of the evaporator, is pressurized by a liquid refrigerant pump and thereafter, the pressurized refrigerant is then supplied to the bearing. Therefore, the liquid refrigerant, which is in a supercooled state, is supplied to the bearing and thus does not evaporate in the bearing. Consequently, the bearing is effectively lubricated by the liquid refrigerant.

In the case of the aforesaid third turborefrigerator of the present invention, the liquid refrigerant cooled by the intercooler is supplied to the bearing after pressurized by the liquid refrigerant pump. Thus, the liquid refrigerant to be supplied to the bearing can be easily brought into the supercooled state. Consequently, the bearing can be effectively lubricated by the liquid refrigerant.

In the case of the aforesaid fourth turborefrigerator of the present invention, the saturated liquid refrigerant, which is condensed by the condenser, is fed to the bearing after pressurized by a liquid refrigerant pump. Thus, the liquid refrigerant to be supplied to the bearing can be easily brought into the supercooled state. Consequently, the bearing can be effectively lubricated by the liquid refrigerant.

In the case of the aforesaid fifth turborefrigerator of the present invention, the saturated refrigerant, which is condensed by said condenser, is supplied to the bearing after supercooled by the supercooler. Consequently, the bearing can be effectively lubricated by the liquid refrigerant.

In the case of the aforesaid sixth turborefrigerator of the present invention, the saturated liquid refrigerant, which is condensed by said condenser, is fed to the bearing after pressurized by the liquid refrigerant pump and supercooled by the supercooler. Consequently, the bearing can be effectively lubricated by the liquid refrigerant.

In the case of the aforesaid seventh turborefrigerator of the present invention, the saturated liquid refrigerant is supercooled by means of the supercooler by causing the saturated liquid refrigerant and the cooling medium to perform the heat exchange therebetween. Consequently, the bearing can be effectively lubricated by the liquid refrigerant.

In the case of the aforesaid eighth turborefrigerator of the present invention, the saturated liquid refrigerant is supercooled by means of the supercooler by causing the saturated liquid refrigerant and the cooled medium to perform the heat exchange therebetween. Consequently, the bearing can be effectively lubricated by the liquid refrigerant.

In the case of the aforesaid ninth turborefrigerator of the present invention, the supercooler comprises a heat transfer tube provided in the evaporator. Further, the saturated liquid refrigerant flowing and passing through the heat transfer tube is supercooled by utilizing latent heat of vaporization of a refrigerant outside the tube. Consequently, the bearing can be effectively lubricated by the liquid refrigerant.

In the case of the aforesaid tenth turborefrigerator of the present invention, the supercooler is installed upstream from the evaporator and supercools the saturated liquid refrigerant by utilizing latent heat of vaporization of a refrigerant having flowed through the throttling mechanism. Consequently, the bearing can be effectively lubricated by the liquid refrigerant.

In the case of the aforesaid eleventh turborefrigerator of the present invention, the supercooler is connected in parallel with the throttling mechanism and supercools the saturated liquid refrigerant by utilizing latent heat of vaporization of a refrigerant having branched off therefrom and flowed through a throttling mechanism of small capacity. Consequently, the bearing can be effectively lubricated by the liquid refrigerant.

In the case of the aforesaid twelfth turborefrigerator of the present invention, the supercooler is inserted into the bypass path and supercools the saturated liquid refrigerant by utilizing latent heat of vaporization of an intermediate-pressure refrigerant having branched off therefrom and flowed through a throttling mechanism of small capacity. Consequently, the bearing can be effectively lubricated by the liquid refrigerant.

In the case of the aforesaid thirteenth turborefrigerator of the present invention, the supercooler is constituted by an evaporator of the small refrigerating cycle. Thus, the liquid refrigerant to be supplied to the bearing can be easily supercooled. Consequently, the bearing can be effectively lubricated by the liquid refrigerant.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF PREFERRED EMBODIMENTS

Figure 1A:
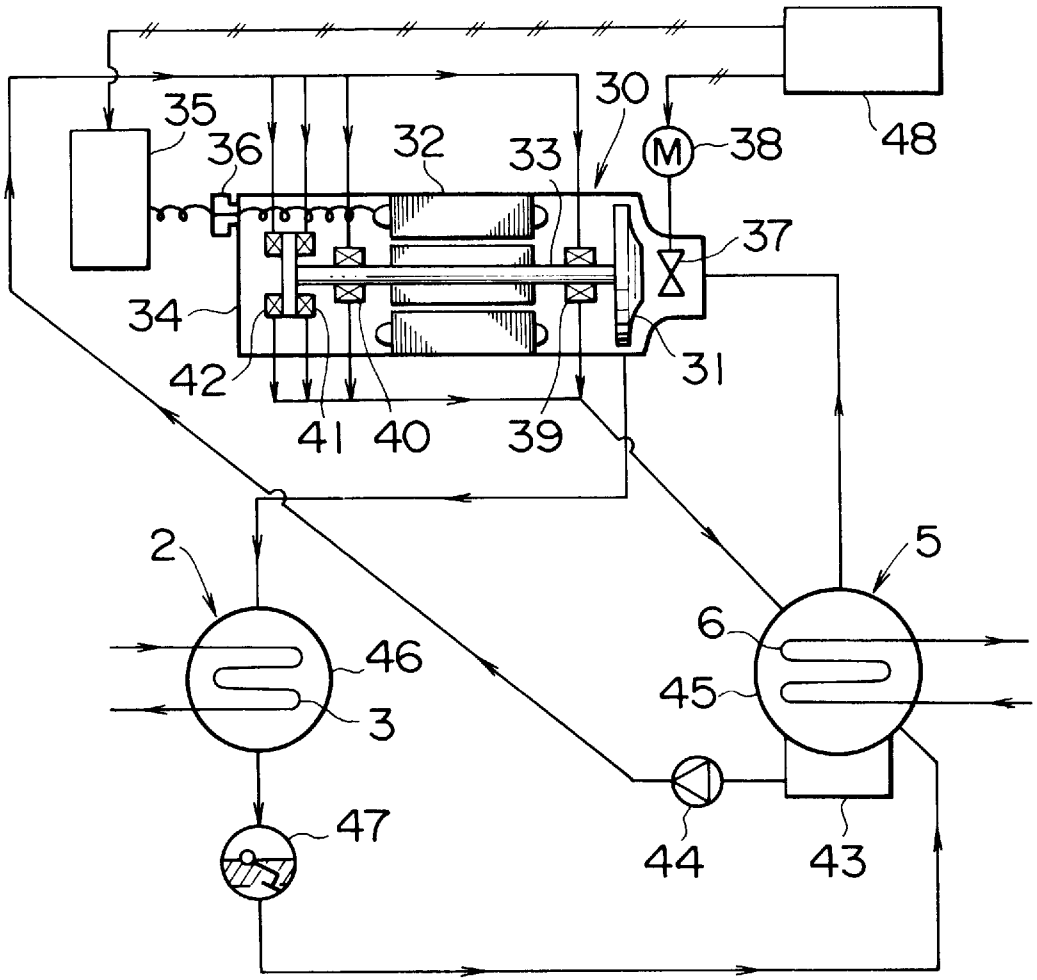
FIG. 1(A) is a system diagram of a turborefrigerator which is a first embodiment of the present invention.
Figure 1B:
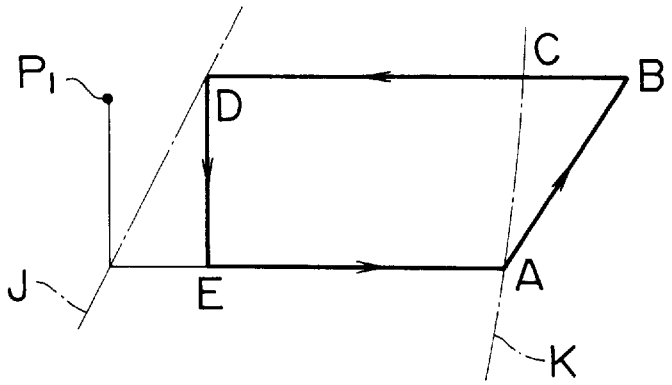
FIG. 1(B) is a Mollier chart of the turborefrigerator which is the first embodiment of the present invention.

FIGS. 1(A) and 1(B) show a turborefrigerator which is a first embodiment of the present invention.

Centrifugal impellers 31 of a turbocompressor 30 are fixedly mounted on an end portion of an output shaft 33 of an inverter motor 32.

Further, the impellers 31 and the inverter motor 32 are enclosed in a single hermetic housing 34.

Electric current, whose frequency is regulated or controlled by an inverter 35, is supplied to the inverter motor 32 through a connecting terminal 36.

Suction vane 37 is provided in the hermetic housing 34 of the turbocompressor 30. This embodiment is adapted so that the quantity of refrigerant gas sucked into the turbocompressor 30 is regulated by opening and closing this suction vanes 37 by means of a motor 38.

Further, the inverter 35 and the suction vane 37 receive commands (or instructions) from a control unit 48 and are then associated with each other and controlled simultaneously.

Output shaft 33 of the inverter motor 32 is supported by radial bearings 39 and 40 and thrust bearings 41 and 42.

Reservoir 43 is formed in the bottom portion of an evaporator 5. Saturated liquid refrigerant contained in the reservoir 43 is extracted by a liquid refrigerant pump 44. Moreover, the extracted liquid refrigerant is pressurized by this liquid refrigerant pump 44 at a predetermined pressure, namely, in such away as to be brought into a supercooled state. This embodiment is adapted so that thereafter, the liquid refrigerant is supplied to and lubricates each of the bearings 39 to 42.

Further, after lubricating the bearings 39 to 42, the liquid refrigerant returns to the housing 45 of the evaporator 5 owing to the self-weight thereof and a differential pressure.

Thus, when operating the turborefrigerator, the gaseous refrigerant discharged from the turbocompressor 30 enters a housing 46 of a condenser 2. In this housing 46, the gaseous refrigerant is condensed and liquefied by dissipating heat to a cooling medium flowing and passing through a heat transfer tube 3.

This liquid refrigerant enters a throttling mechanism 47. Then, the liquid refrigerant is reduced therein, so that adiabatic expansion thereof occurs and simultaneously, the flow rate thereof is regulated. Consequently, a gas-liquid two-phase flow thereof is obtained.

Then, this refrigerant enters the housing 45 of the evaporator 5. Further, this refrigerant evaporates and gasifies by cooling a cooled medium flowing and passing through the heat transfer tube 6. Thereafter, the refrigerant is sucked into the turbocompressor 30 and is then compressed again therein.

Referring now to FIG. 1(B), there is shown Mollier chart of this refrigerating cycle.

Gaseous refrigerant sucked into the turbocompressor 30 when being in a state A is brought into a state B by being compressed by the impeller 31.

This gaseous refrigerant is then put into a state C by being cooled by the condenser 2. Subsequently, this gaseous refrigerant becomes saturated liquid refrigerant, which is in a state D, by being condensed.

This saturated liquid refrigerant is put into a state E by being reduced by the throttling mechanism 47. Subsequently, this refrigerant evaporates in the evaporator 5. Thus, this refrigerant is put into the state A and is then sucked into the turbocompressor 30. Incidentally, J designates a saturated liquid line; K a saturated vapor line.

Thus, the turbocompressor 30 can be rotated at a high speed by increasing the inverter frequency, because the turbocompressor 30 is driven by the inverter motor 32 in the turborefrigerator of this embodiment.

Therefore, the turborefrigerator of this embodiment does not need a speed increasing mechanism, differently from the conventional turborefrigerator. Thus, the structure of a turborefrigerator is simplified. Moreover, the dimensions, weight and cost thereof can be reduced. Further, the mechanical loss thereof can be decreased, so that COP thereof can be enhanced.

Furthermore, the suction vane 37 is provided in the turborefrigerator 30. Further, the turbocompressor 30 is controlled by the control unit 48 by associating the opening of this suction vane 37 (namely, the quantity of intake gas) with the number of revolution of the inverter motor 32. Thus, the efficiency of the turbocompressor 30 can be increased. Consequently, COP of the turborefrigerator can be enhanced.

Moreover, the impellers 31 of the turbocompressor 30 are directly connected to the output shaft 33 of the inverter motor 32. Thus, these composing elements can be enclosed in the single hermetic housing 34. Additionally, the structure of this turborefrigerator can be simplified. Consequently, in the turborefrigerator of this embodiment, the size, weight and cost can be decreased. Further, the mechanical loss thereof can be reduced.

Furthermore, the output shaft 33 of the inverter motor 32 is supported by the bearings 39 to 42 which are lubricated by the liquid refrigerant. Thus, there is no need for using the lubricating oil, differently from the conventional turborefrigerator.

Therefore, the periodic replacement of the lubricating oil is unnecessary, differently from the conventional turborefrigerator. Further, the lubricating oil and the refrigerant do not blend with each other. Thus, the cavitation of the oil pump, the lubrication failure of the bearing and the deterioration in the heat transfer performance of each of the condenser 2 and the evaporator 5 can be prevented.

Moreover, in this embodiment, the saturated liquid refrigerant extracted from the reservoir 43 of the evaporator 5 is supplied to the bearings 39 to 42 after pressurized by the liquid refrigerator pump 44. The liquid refrigerant supplied to the bearings 39 to 42 is in the supercooled state indicated by $P_1$ in Mollier chart of FIG. 1(B). Thus, this liquid refrigerant does not evaporate in the bearings 39 to 42 at all.

Consequently, the bearings 39 to 42 can be effectively lubricated by the liquid refrigerant.

Figure 2A:
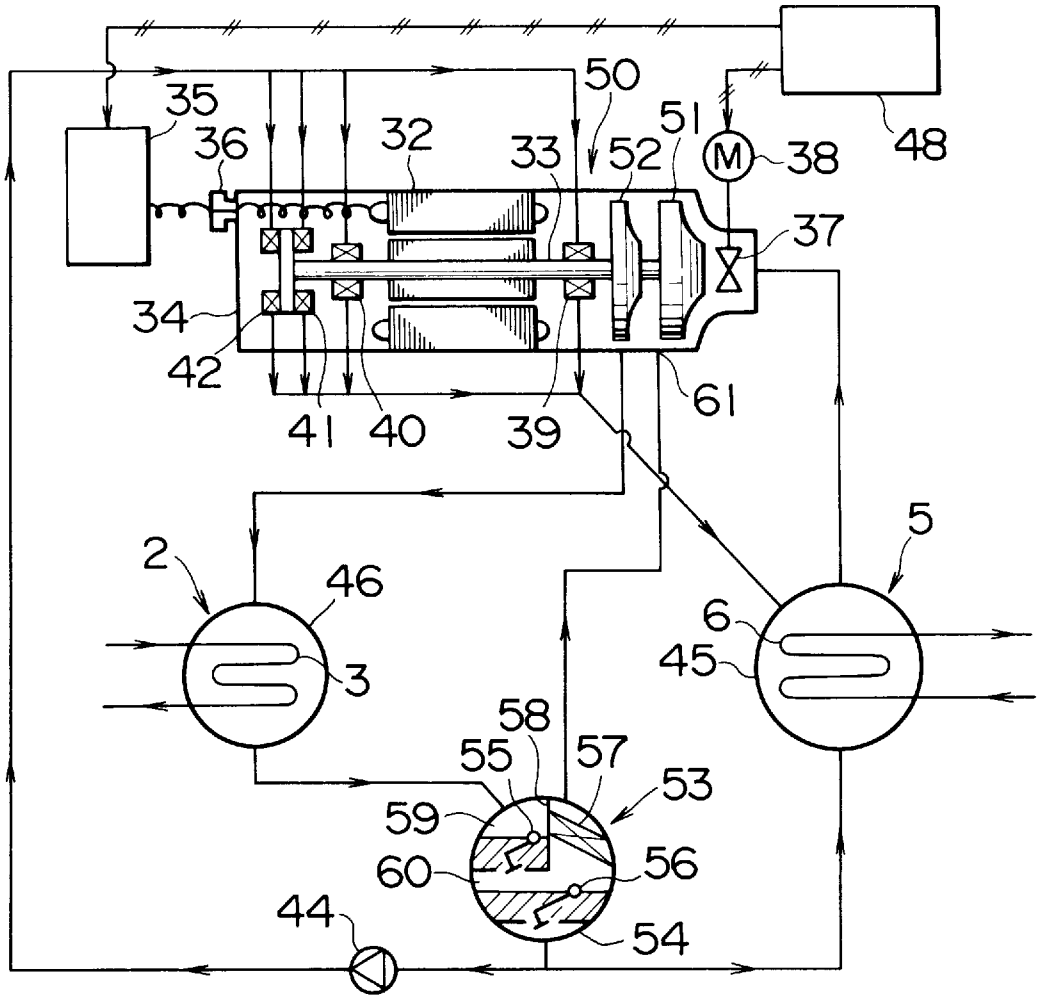
FIG. 2(A) is a system diagram of a turborefrigerator which is a second embodiment of the present invention.
Figure 2B:
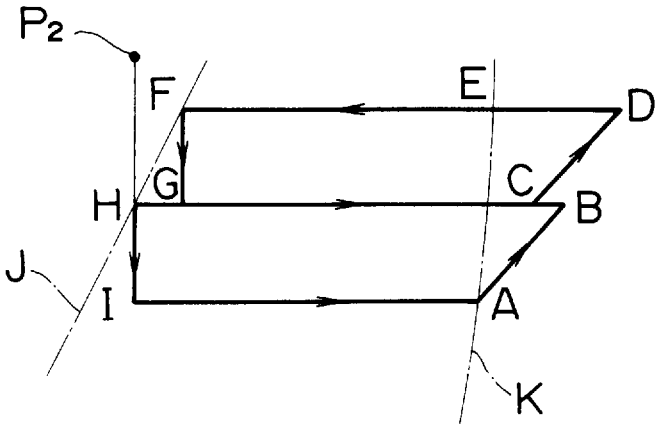
FIG. 2(B) is a Mollier chart of the turborefrigerator which is the second embodiment of the present invention.

Turning now to FIGS. 2(A) and 2(B), there is shown another turborefrigerator which is a second embodiment of the present invention.

In the case of this second embodiment, the turbocompressor is a two-stage turbocompressor 50. Further, all of centrifugal impellers 51 and 52 of the aforesaid turbocompressor 50 are fixedly mounted onto an end portion of the output shaft 33 of the inverter motor 32 in such a manner as to be spaced in the direction of the shaft.

Further, an intercooler 53 for vaporizing a part of the saturated liquid refrigerant, which is condensed by the condenser 2, to thereby cool the remaining part of the refrigerant is provided downstream from the condenser 2.

This intercooler 53 is provided with a high pressure chamber 59 and a low pressure chamber 60, which are formed by partitioning the inner space of the housing 54 by using a diaphragm 58, and with a high-pressure-side throttling mechanism 55, which is incorporated into the high pressure chamber 59, and with a low-pressure-side throttling mechanism 56, which is incorporated into the low pressure chamber 60, and with a mist separator (namely, a demister) 57.

The saturated liquid refrigerant, which is condensed in the condenser 2, is supplied into the high pressure chamber 59 in which the refrigerant comes to have an intermediate pressure by being reduced by means of a high-pressure-side throttling mechanism 55. Then, a part of the refrigerant evaporates in the low pressure chamber 60. Consequently, the remaining part thereof is cooled.

After mist contained in the evaporated gaseous refrigerant is separated and removed therefrom during flowing and passing through the mist separator 57, the refrigerant is sucked from an intermediate suction opening 61 of the turbocompressor 50 into the second impellers 52 and is compressed therein.

The cooled liquid refrigerant is reduced by the low-pressure-side throttling mechanism 56 again, so that adiabatic expansion thereof is caused and the flow rate thereof is regulated. Then, this liquid refrigerant is supplied to the evaporator 5.

This embodiment is adapted so that after a part of the liquid refrigerant cooled by this intercooler 53 is pressurized by the liquid refrigerant pump 44, the liquid refrigerant is supplied to and lubricates the bearings 39 to 42.

The other composing members or elements of this embodiment are similar to those of the first embodiment illustrated in FIGS. 1(A) and 1(B). In FIGS. 2(A) and 2(B), same reference characters designate corresponding members. Further, the descriptions of such members are omitted herein.

Thus, in this second embodiment, the liquid refrigerant supplied to the bearings 39 to 42 is in the supercooled state indicated by $P_2$ in Mollier chart of FIG. 2(B). Thus, the liquid refrigerant is prevented from evaporating in the bearings 39 to 42. Moreover, as compared with the first embodiment, the size of the liquid refrigerant pump 44 can be reduced and the driving force or power thereof can be saved.

Figure 3A:
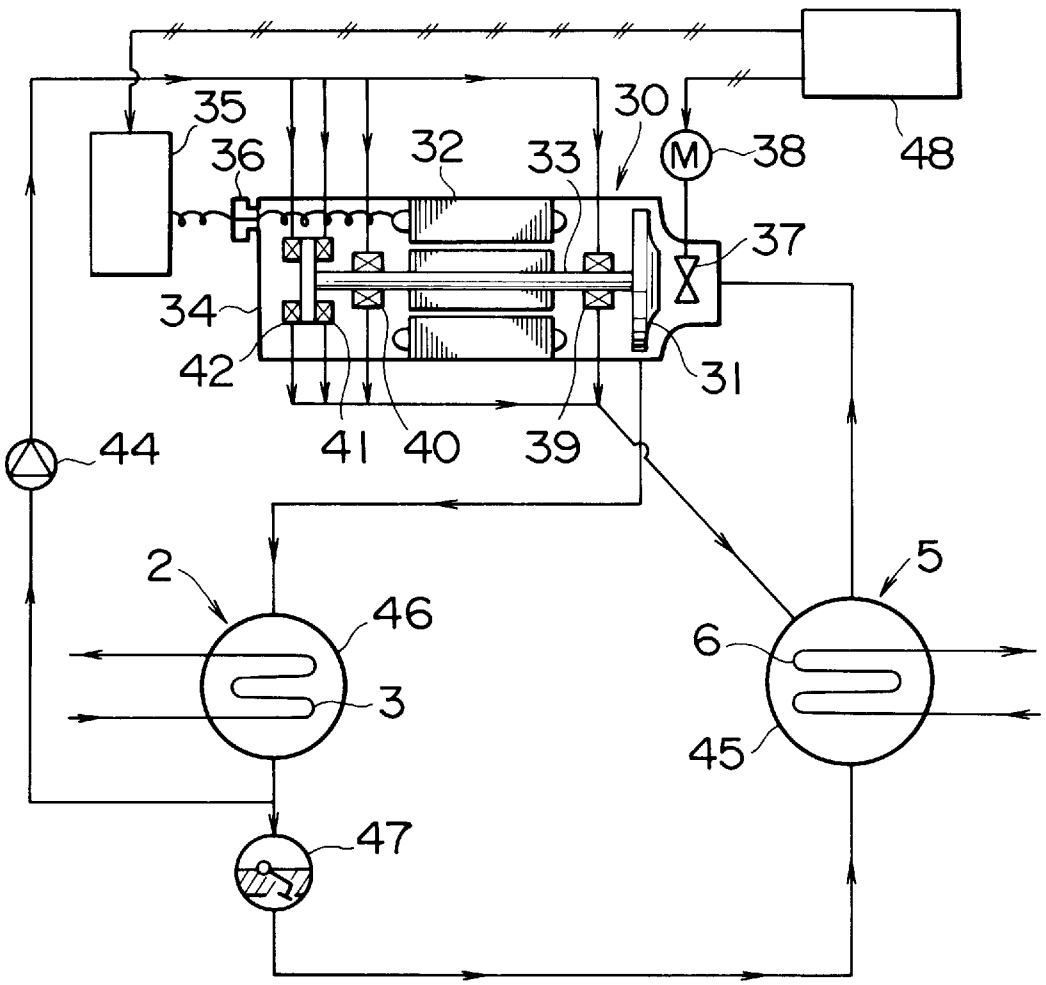
FIG. 3(A) is a system diagram of a turborefrigerator which is a third embodiment of the present invention.
Figure 3B:
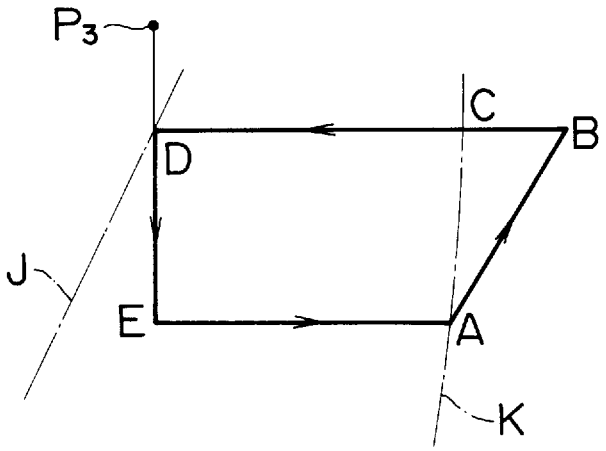
FIG. 3(B) is a Mollier chart of the turborefrigerator which is the third embodiment of the present invention.

Referring next to FIGS. 3(A) and 3(B), there is shown another turborefrigerator which is a third embodiment of the present invention.

This third embodiment is adapted so that the saturated liquid refrigerant, which is condensed by the condenser 2, is supplied to the bearings 39 to 42 after pressurized by the liquid refrigerant pump 44.

The other composing members or elements of this embodiment are similar to those of the first embodiment illustrated in FIGS. 1(A) and 1(B). In FIGS. 3(A) and 3(B), same reference characters designate corresponding members. Further, the descriptions of such members are omitted herein.

Thus, in this third embodiment, the liquid refrigerant supplied to the bearings 39 to 42 is in the supercooled state indicated by $P_3$ in Mollier chart of FIG. 3(B). Thus, the bearings 39 to 42 can be effectively lubricated by this liquid refrigerant.

Turning next to FIGS. 4(A) to 4(D), there is illustrated another turborefrigerator which is a fourth embodiment of the present invention.

This fourth embodiment is adapted so that the saturated liquid refrigerant is supplied to the bearings 39 to 42 after the refrigerant enters a tank 63 of the supercooler 62 and is then supercooled by performing the heat exchange between the refrigerant and the cooling medium flowing and passing through the heat transfer tube 64 thereof, and that the cooling medium issued from the heat transfer tube 64 flows into the heat transfer tube 3 of the condenser 2.

Figure 4A:
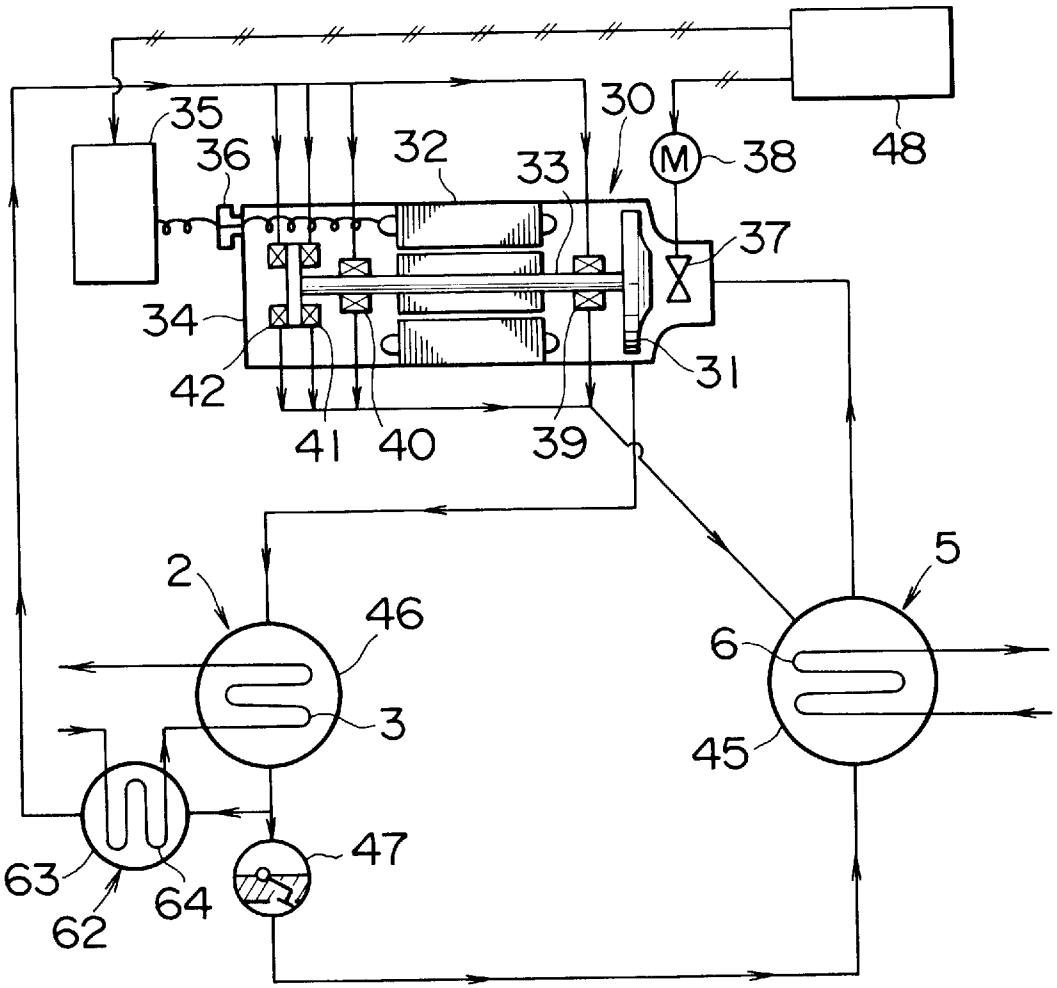
FIG. 4(A) is a system diagram of a turborefrigerator which is a fourth embodiment of the present invention.
Figure 4B:
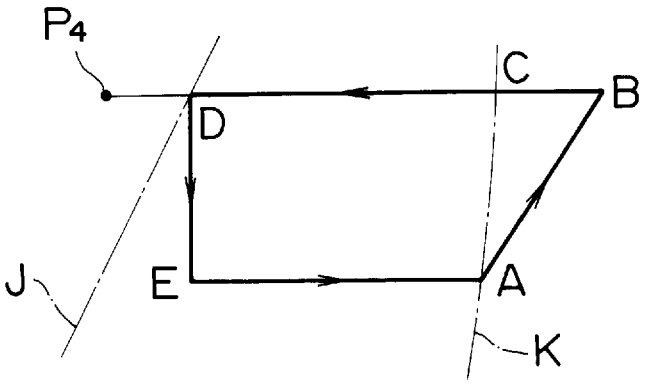
FIG. 4(B) is a Mollier chart of the turborefrigerator which is the fourth embodiment of the present invention.
Figure 4C:
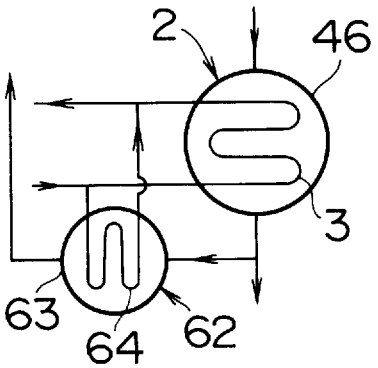
FIGS. 4(C) and 4(D) are diagrams respectively illustrating modifications of the fourth embodiment of the present invention.
Figure 4D:
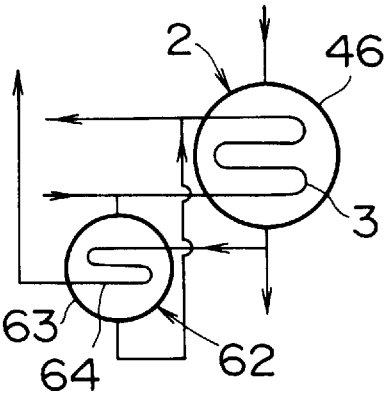

Incidentally, as shown in FIG. 4(C), this fourth embodiment can be modified in such a way that the cooling medium is branched and thus a part of the cooling medium is made to flow into the heat transfer tube 64 of the supercooler 62, and that the rest of the cooling medium is made to flow into the heat transfer tube 3 of the condenser 2. Further, as shown in FIG. 4(D), this fourth embodiment can be modified in such a manner that the liquid refrigerant is caused to flow through the heat transfer tube 64 and that this liquid refrigerant and an external cooling medium, which is provided outside this tube, are caused to perform the heat exchange therebetween.

The other composing members or elements of this fourth embodiment are similar to those of the first embodiment illustrated in FIGS. 1(A) and 1(B). In FIGS. 4(A) and 4(B), same reference characters designate corresponding members. Further, the descriptions of such members are omitted herein.

Thus, in this fourth embodiment, the liquid refrigerant, which is cooled by lowering the temperature thereof about 5° C. and is then supplied to the bearings 39 to 42, is in the supercooled state indicated by $P_4$ in Mollier chart of FIG. 4(B). Thus, the bearings 39 to 42 can be effectively lubricated by this liquid refrigerant.

Figure 5A:
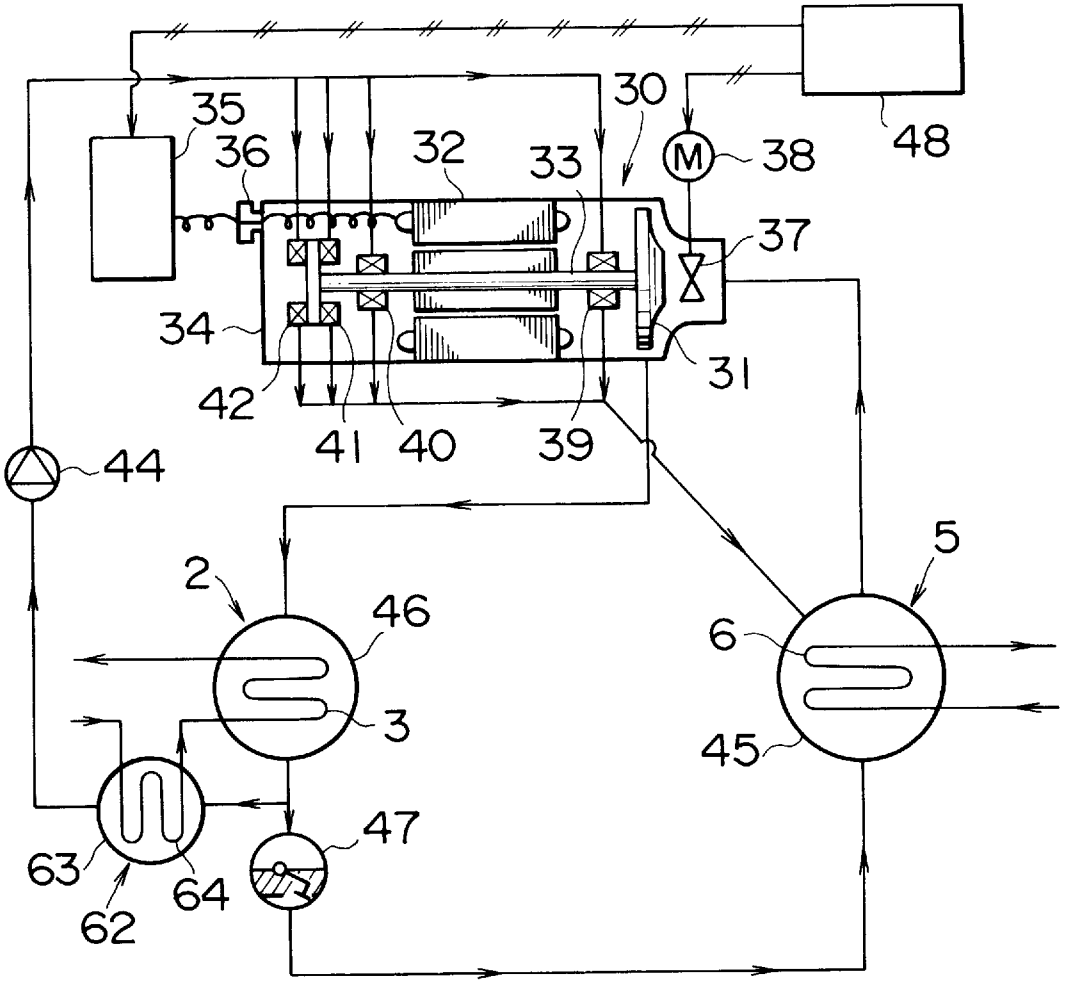
FIG. 5(A) is a system diagram of a turborefrigerator which is a fifth embodiment of the present invention.
Figure 5B:
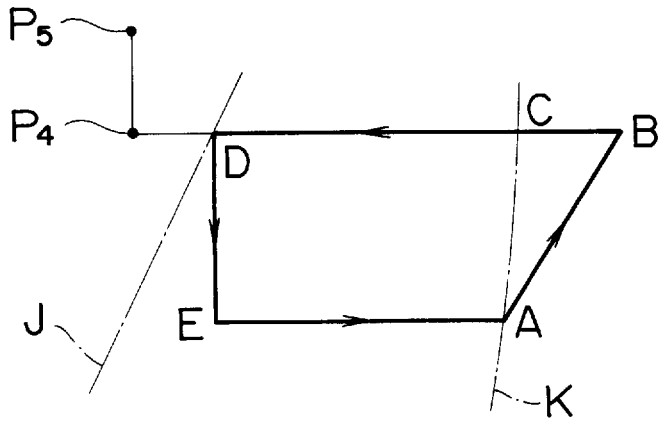
FIG. 5(B) is a Mollier chart of the turborefrigerator which is the fifth embodiment of the present invention.

Referring now to FIGS. 5(A) and 5(B), there is shown another turborefrigerator which is a fifth embodiment of the present invention.

This fifth embodiment is adapted so that, after supercooled by the supercooler 62, the saturated liquid refrigerant, which is condensed by the condenser 2, is pressurized by the liquid refrigerant pump 44 and is then supplied to the bearings 39 to 42.

The other composing members or elements of this embodiment are similar to those of the first embodiment illustrated in FIGS. 4(A) and 4(B). In FIGS. 5(A) and 5(B), same reference characters designate corresponding members. Further, the descriptions of such members are omitted herein.

Thus, in this fifth embodiment, the liquid refrigerant supplied to the bearings 39 to 42 is in the supercooled state indicated by $P_5$ in Mollier chart of FIG. 5(B). Thus, the bearings 39 to 42 can be effectively lubricated by this liquid refrigerant.

Turning now to FIGS. 6(A) to 6(D), there is illustrated another turborefrigerator which is a sixth embodiment of the present invention.

This sixth embodiment is adapted so that the saturated liquid refrigerant, which is condensed by the condenser 2, enters the tank 68 of the supercooler 66 and that such a liquid refrigerant and the cooled medium flowing and passing through the heat transfer tube 67 are caused to perform the heat exchange therebetween, thereby supercooling the liquid refrigerant.

Figure 6A:
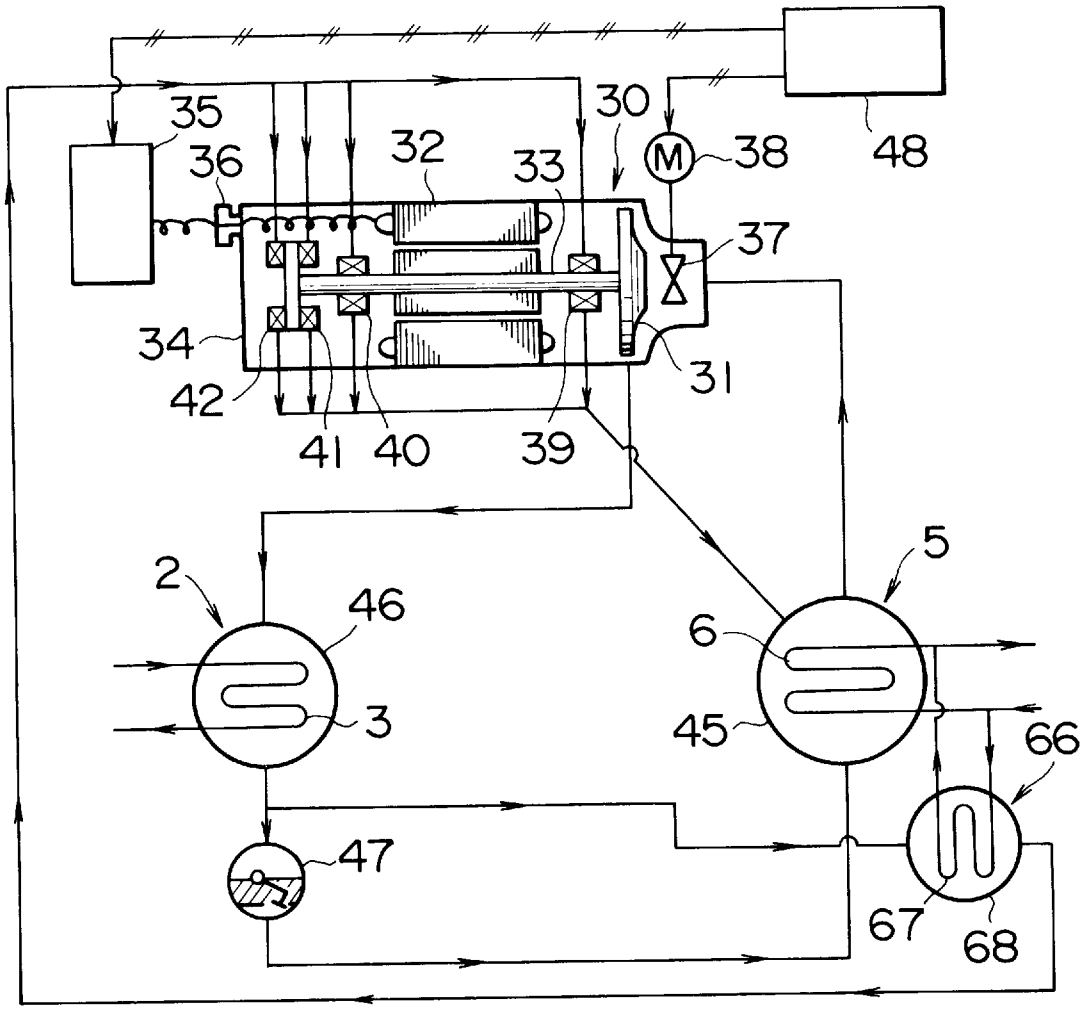
FIG. 6(A) is a system diagram of a turborefrigerator which is a sixth embodiment of the present invention.
Figure 6B:
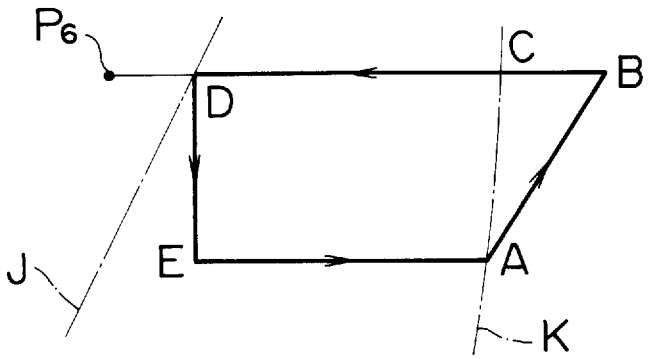
FIG. 6(B) is a Mollier chart of the turborefrigerator which is the sixth embodiment of the present invention.
Figure 6C:
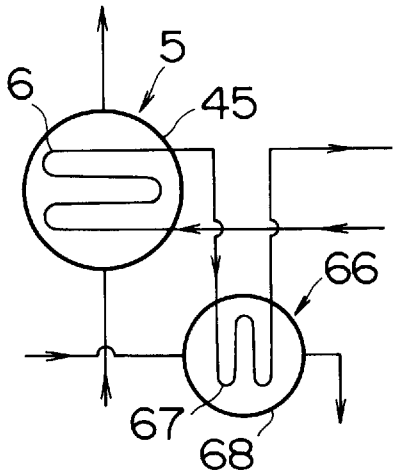
FIGS. 6(C) and 6(D) are diagrams respectively illustrating modifications of the sixth embodiment of the present invention.
Figure 6D:
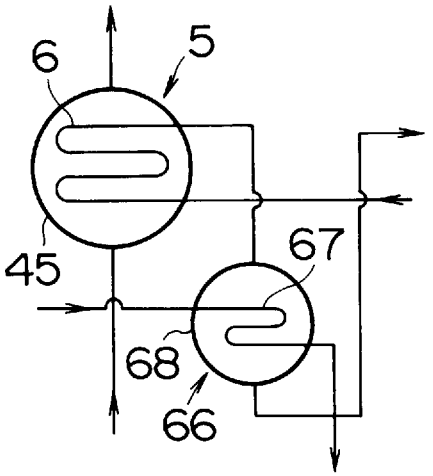

Incidentally, as shown in FIG. 6(C), this sixth embodiment can be modified in such a way that the cooled medium cooled by flowing and passing through the heat transfer tube 6 of the evaporator 5 is made to flow into the heat transfer tube 67 of the supercooler 66. Further, as shown in FIG. 6(D), this sixth embodiment can be modified in such a manner that the cooled medium, which is cooled by flowing and passing through the heat transfer tube 6 of the evaporator 5, is made to cool the saturated liquid refrigerant flowing and passing through the heat transfer tube 67 during a process in which the cooled medium flows through the tank 68 of the supercooler 66.

The other composing members or elements of this fourth embodiment are similar to those of the first embodiment illustrated in FIGS. 1(A) and 1(B).

Thus, in this sixth embodiment, the liquid refrigerant supplied to the bearings 39 to 42 is in the supercooled state indicated by $P_6$ in Mollier chart of FIG. 6(B). Thus, the bearings 39 to 42 can be effectively lubricated by this liquid refrigerant.

Figure 7A:
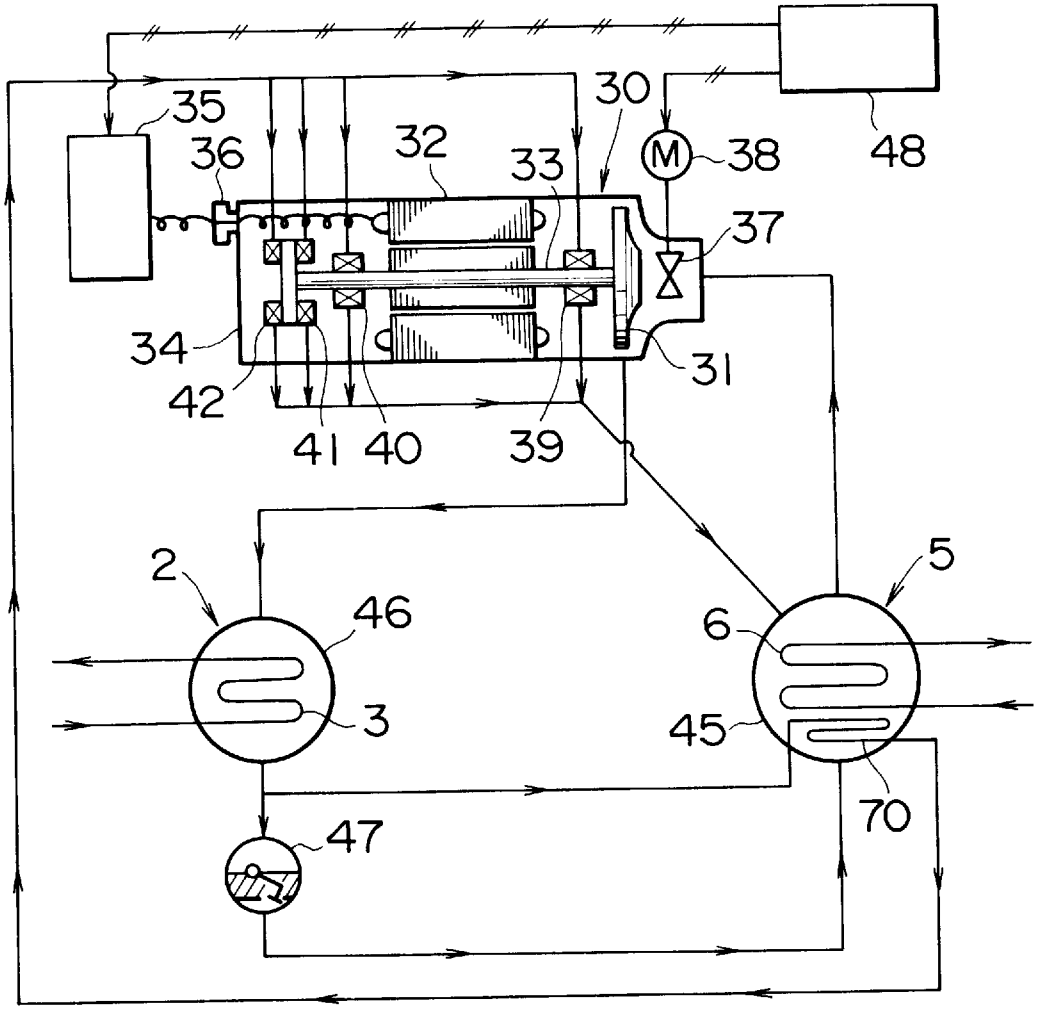
FIG. 7(A) is a system diagram of a turborefrigerator which is a seventh embodiment of the present invention.
Figure 7B:
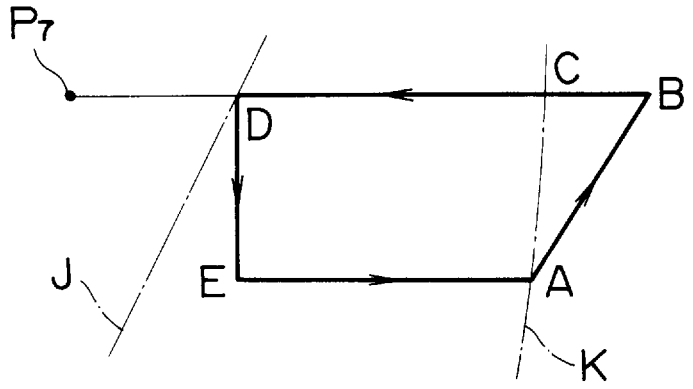
FIG. 7(B) is a Mollier chart of the turborefrigerator which is the seventh embodiment of the present invention.

Referring next to FIGS. 7(A) and 7(B), there is illustrated another turborefrigerator which is a seventh embodiment of the present invention.

In the case of this seventh embodiment, the heat transfer tube 70 installed in the housing 45 of the evaporator 5 composes a supercooler.

Thus, this seventh embodiment is adapted so that a part of the saturated liquid refrigerant, which is condensed by the condenser 2, enters the heat transfer tube 70 and that, during a process in which the liquid refrigerant flows through the inside of this tube 70, the liquid refrigerant is supercooled by latent heat of vaporization of a cooling medium being present outside the tube 70.

The other composing members or elements of this fourth embodiment are similar to those of the first embodiment illustrated in FIGS. 1(A) and 1(B).

Thus, in this seventh embodiment, the liquid refrigerant supplied to the bearings 39 to 42 is in the supercooled state indicated by $P_7$ in Mollier chart of FIG. 7(B). Thus, the bearings 39 to 42 can be effectively lubricated by this liquid refrigerant.

Turning to FIGS. 8(A) to 8(D), there is illustrated another turborefrigerator which is an eighth embodiment of the present invention.

This eighth embodiment is adapted so that the supercooler 72 is installed upstream from the evaporator 5, and that the gas-liquid two-phase refrigerant, which has performed the adiabatic expansion in the throttling mechanism 47, is introduced to the tank 74 of the supercooler 72 in which a part of this refrigerant evaporates.

Thus, during a process in which the saturated liquid refrigerant, which is condensed by the condenser 2, flows through the inside of the heat transfer tube 73 of the supercooler 72, this saturated liquid refrigerant is supercooled by latent heat of vaporization of a cooling medium being present outside the tube 73.

Figure 8A:
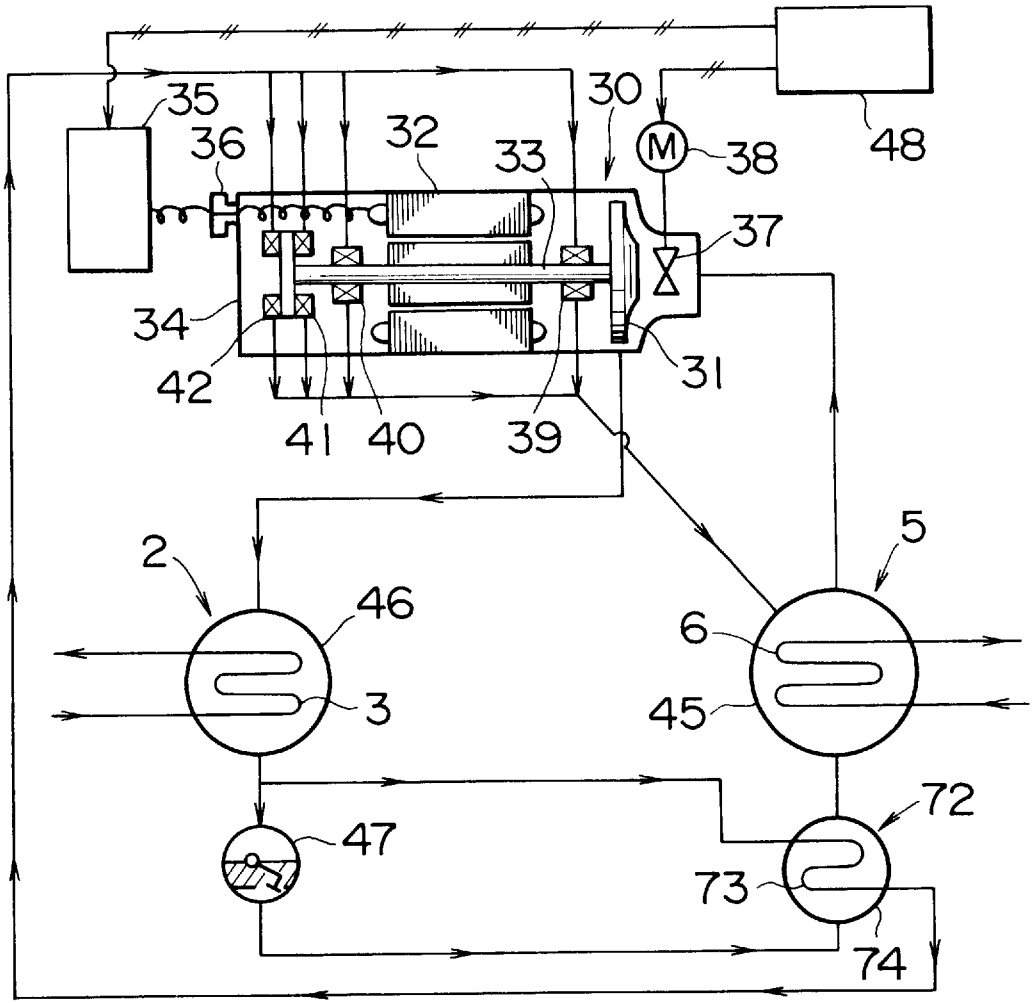
FIG. 8(A) is a system diagram of a turborefrigerator which is an eighth embodiment of the present invention.
Figure 8B:
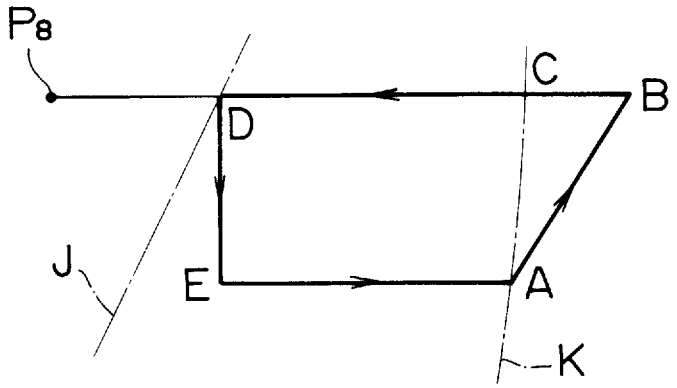
FIG. 8(B) is a Mollier chart of the turborefrigerator which is the eighth embodiment of the present invention.
Figure 8C:
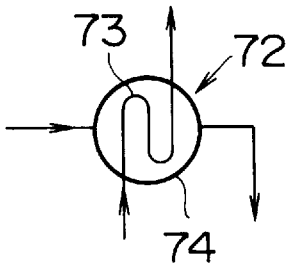
FIG. 8(C) is a diagram illustrating a modification of the eighth embodiment of the present invention.

Incidentally, as shown in FIG. 8(C), this eighth embodiment can be modified in such a way that the saturated liquid refrigerant is introduced into the tank 74 and is supercooled by latent heat of vaporization of a cooling medium flowing through the inside of the heat transfer tube 73.

The other composing members or elements of this fourth embodiment are similar to those of the first embodiment illustrated in FIGS. 1(A) and 1(B).

Thus, in this eighth embodiment, the liquid refrigerant supplied to the bearings 39 to 42 is in the supercooled state indicated by $P_8$ in Mollier chart of FIG. 8(B). Consequently, the bearings 39 to 42 can be effectively lubricated by this liquid refrigerant.

Figure 9A:
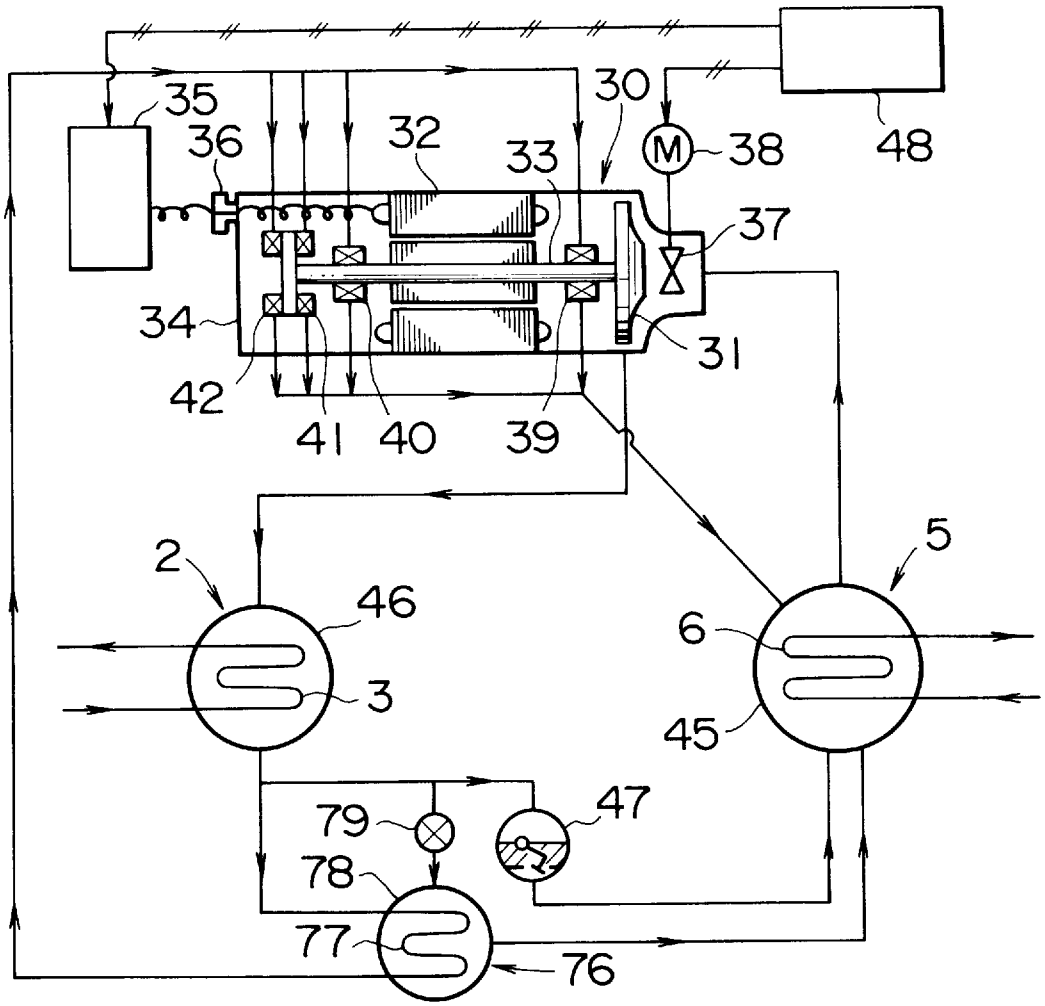
FIG. 9(A) is a system diagram of a turborefrigerator which is a ninth embodiment of the present invention.
Figure 9B:
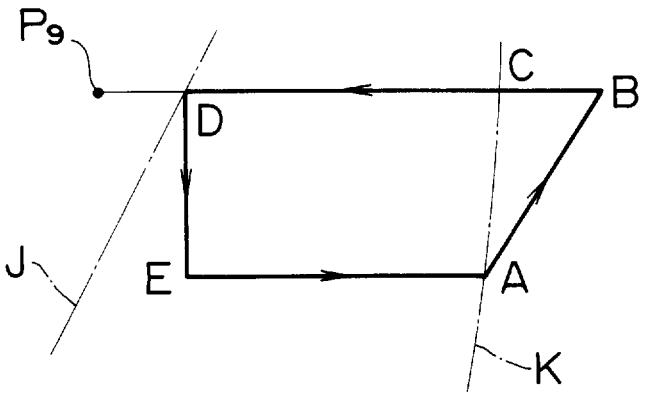
FIG. 9(B) is a Mollier chart of the turborefrigerator which is the ninth embodiment of the present invention.
Figure 9C:
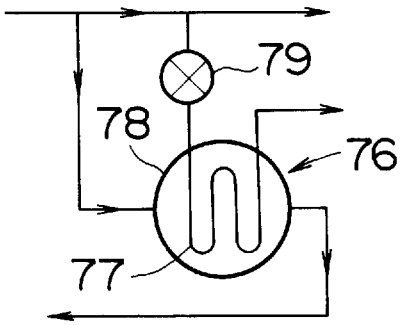
FIG. 9(C) is a diagram illustrating a modification of the ninth embodiment of the present invention.

Referring next to FIGS. 9(A) to 9(C), there is illustrated another turborefrigerator which is a ninth embodiment of the present invention.

In this ninth embodiment, the supercooler 76 is connected in parallel with the throttling mechanism 47.

Thus, the saturated liquid refrigerant, which is condensed by the condenser 2 is branched and most of the saturated liquid refrigerant flows into the evaporator 5 through the throttling mechanism 47. However, a part of the saturated liquid refrigerant enters the tank 78 of the supercooler 76 through a throttling mechanism 79 of small capacity. Then, such a part of the saturated liquid refrigerant evaporates by the heat exchange between this saturated liquid refrigerant and the saturated liquid refrigerant flowing and passing through the inside of the heat transfer tube 77. Thereafter, the refrigerant is introduced to the evaporator 5.

The liquid refrigerant supercooled by latent heat of vaporization of a cooling medium being present outside the tube in a process during which the liquid refrigerant flows through the inside of the heat transfer tube 77, is supplied to the bearings 39 to 42. Incidentally, as illustrated in FIG. 9(C), this embodiment can be modified in such a way that the cooling medium flowing and passing through the throttling mechanism 79 of small capacity is introduced into the heat transfer tube 77 of the supercooler 76, and thus the saturate liquid refrigerant flowing and passing through the inside of the tank 78 can be supercooled.

The other composing members or elements of this ninth embodiment are similar to those of the first embodiment illustrated in FIGS. 1(A) and 1(B).

Thus, in this ninth embodiment, the liquid refrigerant supplied to the bearings 39 to 42 is in the supercooled state indicated by $P_9$ in Mollier chart of FIG. 9(B). Consequently, the bearings 39 to 42 can be effectively lubricated by this liquid refrigerant.

Figure 10A:
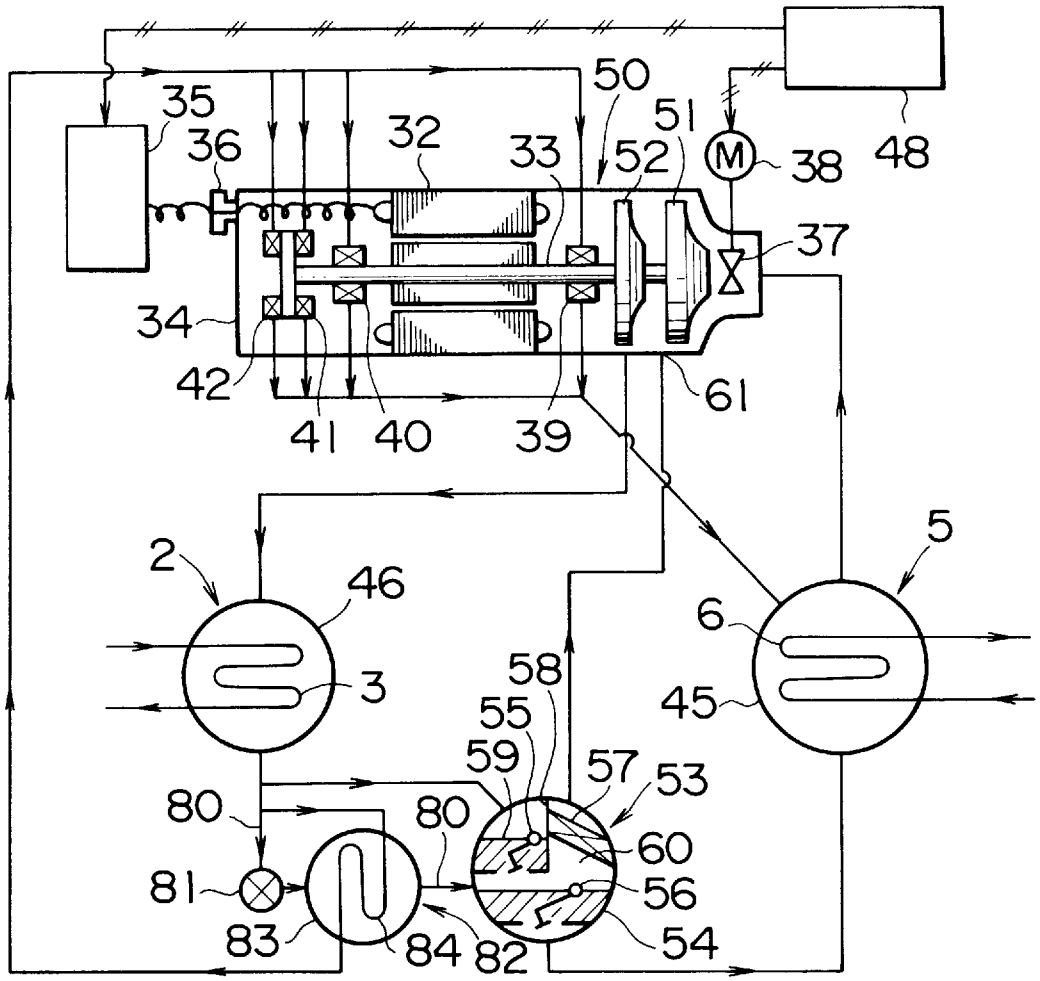
FIG. 10(A) is a system diagram of a turborefrigerator which is a tenth embodiment of the present invention.
Figure 10B:
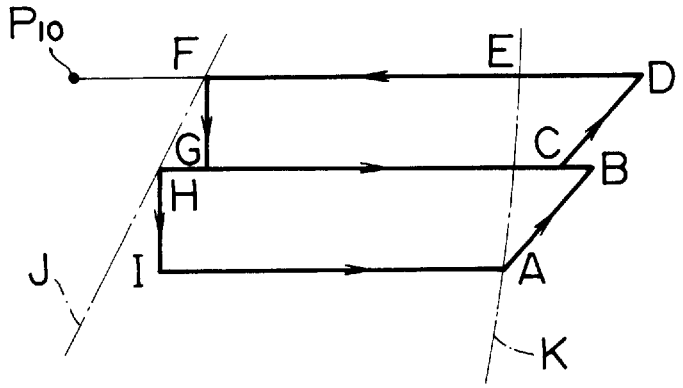
FIG. 10(B) is a Mollier chart of the turborefrigerator which is the tenth embodiment of the present invention.
Figure 10C:
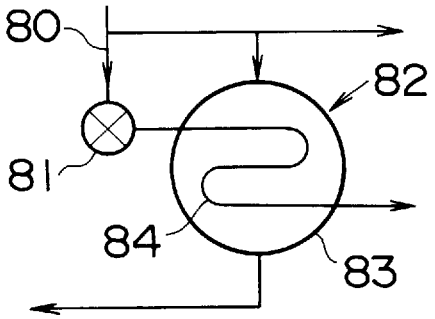
FIG. 10(C) is a diagram illustrating a modification of the tenth embodiment of the present invention.

Turning next to FIGS. 10(A) to 10(C), there is illustrated another turborefrigerator which is a tenth embodiment of the present invention.

In this tenth embodiment, a bypass path 80 for branching a part of the saturated liquid refrigerant, which is condensed by the condenser 2, and for introducing the branched part thereof to the low pressure chamber 60 of the intercooler 53 is provided upstream from the intercooler 53. Moreover, a throttling mechanism 81 of small capacity and a supercooler 82 are inserted into this bypass path 80.

Thus, a part of the saturated liquid refrigerant enters the tank 83 of the supercooler 82 and evaporates therein after the pressure if the pressure is reduced to an intermediate pressure by reducing the refrigerant by means of the throttling mechanism 81 of small capacity. Thereby, the saturated liquid refrigerant, which is branched from upstream of the throttling mechanism 81 and flows and passes through the heat transfer tube 84, is supercooled. Thereafter, the part of the liquid refrigerant is introduced to the low pressure chamber 60 of the intercooler 53.

The saturated liquid refrigerant, which is supercooled by flowing and passing the inside of the heat transfer tube 84, is introduced to the bearings 39 to 42.

Incidentally, as illustrated in FIG. 10(C), the saturated liquid refrigerant placed outside the heat transfer tube 84 of the supercooler 82 can be supercooled by causing the refrigerant, whose pressure is reduced by the throttling mechanism 81 of small capacity, to evaporate in the heat transfer tube 84 of the supercooler 82.

The other composing members or elements of this tenth embodiment are similar to those of the second embodiment illustrated in FIGS. 2(A) and 2(B).

Thus, in this tenth embodiment, the liquid refrigerant supplied to the bearings 39 to 42 is in the supercooled state indicated by $P_{10}$ in Mollier chart of FIG. 10(B). Consequently, the bearings 39 to 42 can be effectively lubricated by this liquid refrigerant.

Figure 11A:
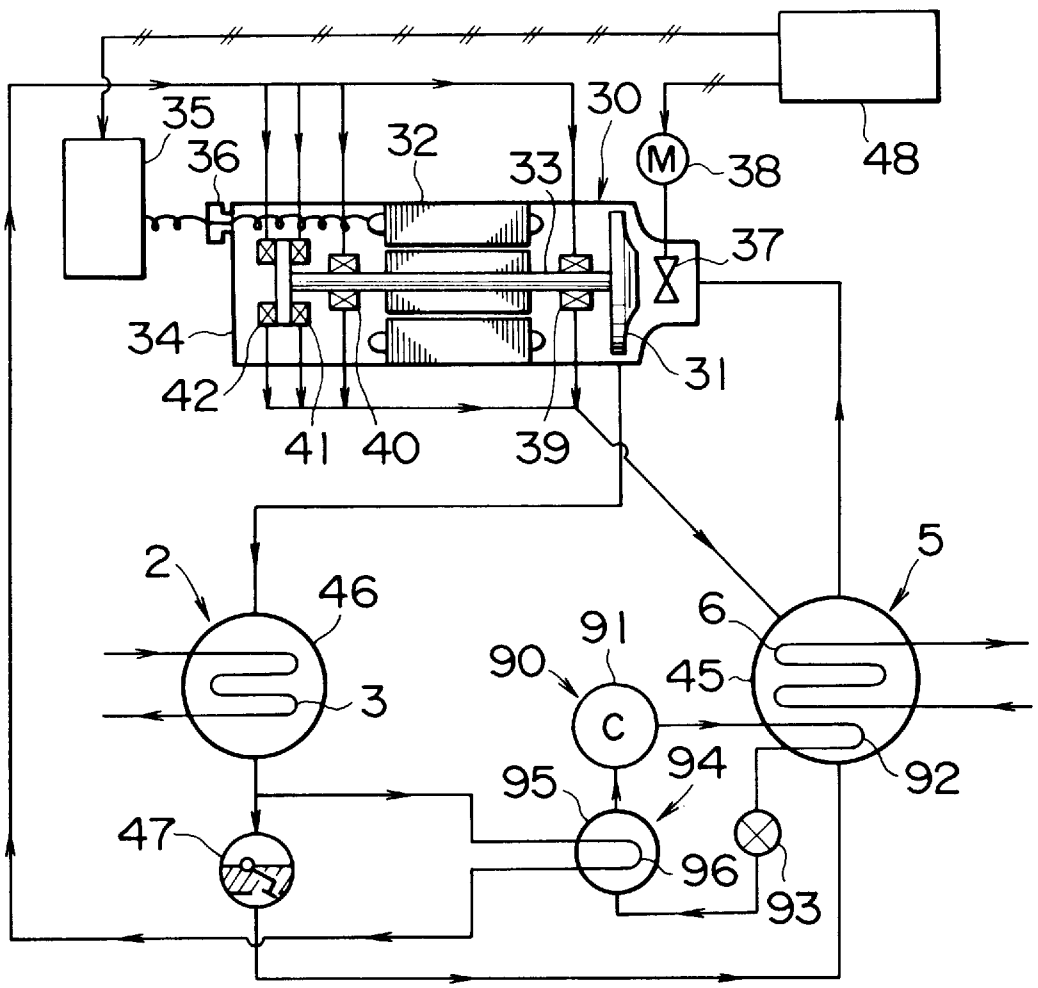
FIG. 11(A) is a system diagram of a turborefrigerator which is an eleventh embodiment of the present invention.
Figure 11B:
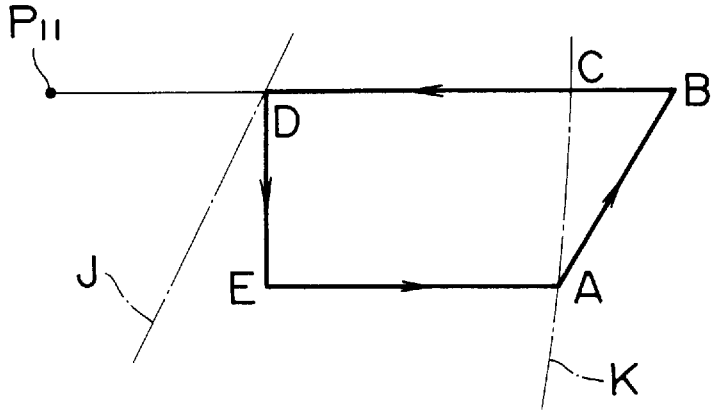
FIG. 11(B) is a Mollier chart of the turborefrigerator which is the eleventh embodiment of the present invention.
Figure 12A:
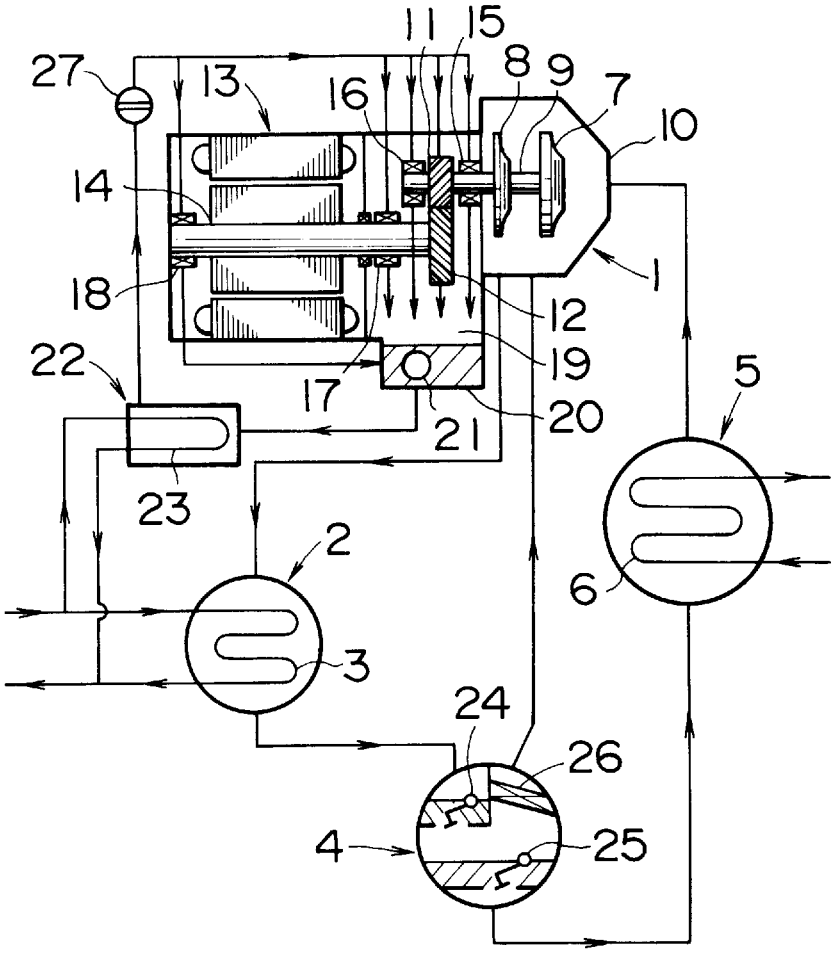
FIG. 12A RELATED ART
FIG. 12(A) is a system diagram of a conventional turborefrigerator.
Figure 12B:
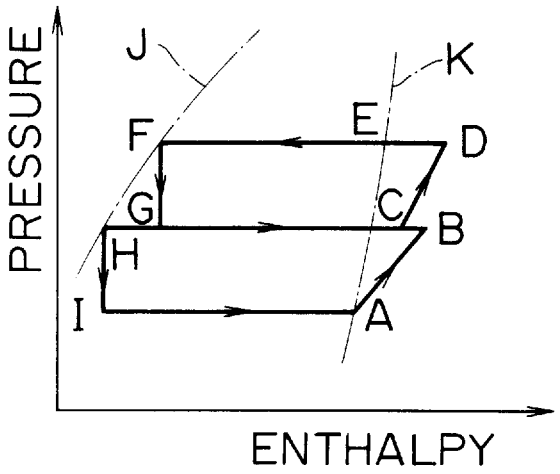
FIG. 12B RELATED ART
FIG. 12(B) is a Mollier chart of the conventional turborefrigerator.

Referring to FIGS. 11(A) and 11(B), there is illustrated another turborefrigerator which is an eleventh embodiment of the present invention.

In this eleventh embodiment, the small refrigerating cycle 90 is provided upstream from the evaporator 5. This refrigerating cycle 90 consists of the compressor 91, the condenser 92, the throttling mechanism 93 and the evaporator 94.

The aforesaid condenser 92 is constituted by a heat transfer tube installed in the housing 45 of the evaporator 5. The aforementioned evaporator 94 composes a supercooler by installing the heat transfer tube 96, through which the saturated liquid refrigerant flows and passes, in the tank 95 thereof.

Thus, when operating the compressor 91 of this small refrigerating cycle 90, the refrigerant discharged from the compressor 91 is cooled and liquefied in a process, during which the discharged refrigerant flows and passes through the heat transfer tube 92, by latent heat of vaporization of a refrigerant which is present outside the tube 92. This liquid refrigerant enters the tank 95 of the evaporator 94 through the throttling mechanism 93. This liquid refrigerant evaporates by absorbing heat from the saturated liquid refrigerant flowing and passing through the heat transfer tube 96. Thereafter, the evaporated refrigerant is sucked into the compressor 91 and is compressed once again.

The liquid refrigerant, which is supercooled by flowing and passing through the inside of the heat transfer tube 96, is supplied to the bearings 39 to 42.

Thus, in this eleventh embodiment, the liquid refrigerant supplied to the bearings 39 to 42 is in the supercooled state indicated by $P_{11}$ in Mollier chart of FIG. 11(B). Consequently, the bearings 39 to 42 can be effectively lubricated by this liquid refrigerant.

Although preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

We claim:

1. A turborefrigerator comprising: a turbocompressor and a refrigerant discharged from said turbocompressor;

a condenser wherein said refrigerant is condensed in said condenser by dissipating heat to a cooling medium so as to form a saturated liquid refrigerant;

a throttling mechanism wherein said saturated liquid refrigerant is then reduced by said throttling mechanism;

an evaporator having a cooled medium wherein the refrigerant evaporates by absorbing heat from the cooled medium and wherein the refrigerant is then circulated to said turbocompressor;

an inverter motor whose output shaft is directly connected to an impeller of said turbocompressor and which is supported by a bearing lubricated by a liquid refrigerant; and a control unit adapted to control both of a suction vane, which is provided in said turbocompressor, and said inverter motor wherein opening of said suction vane is a function of a number of revolutions of said inverter motor.

2. The turborefrigerator as set forth in claim 1, wherein a saturated liquid refrigerant extracted from a reservoir of said evaporator is pressurized by a liquid refrigerant pump and thereafter, the pressurized refrigerant is then supplied to said bearing.

3. The turborefrigerator as set forth in claim 1, which further comprises an intercooler for cooling a part of the saturated liquid refrigerant condensed by said condenser, the remaining part of which evaporates, wherein said turbocompressor is a multistage turbocompressor, and wherein the liquid refrigerant cooled by said intercooler is pressurized by a liquid refrigerant pump and thereafter, the pressurized refrigerant is supplied to said bearing.

4. The turborefrigerator as set forth in claim 1, wherein the saturated liquid refrigerant condensed by said condenser is pressurized by a liquid refrigerant pump and thereafter, the pressurized refrigerant is fed to said bearing.

5. The turborefrigerator as set forth in claim 1, wherein the saturated refrigerant, which is condensed by said condenser, is supercooled by a supercooler and thereafter, the supercooled refrigerant is supplied to said bearing.

6. The turborefrigerator as set forth in claim 1, wherein the saturated liquid refrigerant, which is condensed by said condenser, is pressurized by a liquid refrigerant pump and is supercooled by a supercooler and thereafter, the pressurized and supercooled liquid refrigerant is fed to said bearing.

7. The turborefrigerator as set forth in claim 5, wherein the saturated liquid refrigerant is supercooled by said supercooler by causing the saturated liquid refrigerant and the cooling medium to perform heat exchange therebetween.

8. The turborefrigerator as set forth in claim 5, wherein the saturated liquid refrigerant is supercooled by said supercooler by causing the saturated liquid refrigerant and the cooled medium to perform heat exchange therebetween.

9. The turborefrigerator as set forth in claim 5, wherein said supercooler comprises a heat transfer tube provided in said evaporator and wherein the saturated liquid refrigerant flowing and passing through said heat transfer tube is supercooled by utilizing latent heat of vaporization of a refrigerant outside said tube.

10. The turborefrigerator as set forth in claim 5, wherein said supercooler is installed upstream from said evaporator and supercools the saturated liquid refrigerant by utilizing latent heat of vaporization of a refrigerant having flowed through said throttling mechanism.

11. The turborefrigerator as set forth in claim 5, wherein said supercooler is connected in parallel with said throttling mechanism and supercools the saturated liquid refrigerant by utilizing latent heat of vaporization of a refrigerant having branched off therefrom and flowed through a throttling mechanism of small capacity.

12. The turborefrigerator as set forth in claim 5, which further comprises:

an intercooler having a high-pressure-side throttling mechanism and a low-pressure-side throttling mechanism; and a bypass path for introducing a part of the saturated liquid refrigerant into an upstream side of said low-pressure-side throttling mechanism of said intercooler, wherein said turbocompressor is a multistage turbocompressor, and wherein said supercooler is inserted into said bypass path and supercools the saturated liquid refrigerant by utilizing latent heat of vaporization of an intermediate-pressure refrigerant having branched off therefrom and flowed through a throttling mechanism of small capacity.

13. The turborefrigerator as set forth in claim 5, which further comprises: another small refrigerating cycle from which heat is absorbed in said evaporator, wherein said supercooler is constituted by an evaporator of said small refrigerating cycle.

14. The turborefrigerator as set forth in claim 6, wherein the saturated liquid refrigerant is supercooled by said supercooler by causing the saturated liquid refrigerant and the cooling medium to perform heat exchange therebetween.

15. The turborefrigerator as set forth in claim 6, wherein the saturated liquid refrigerant is supercooled by said supercooler by causing the saturated liquid refrigerant and the cooled medium to perform heat exchange therebetween.

16. The turborefrigerator as set forth in claim 6, wherein said supercooler comprises a heat transfer tube provided in said evaporator and wherein the saturated liquid refrigerant flowing and passing through said heat transfer tube is supercooled by utilizing latent heat of vaporization of a refrigerant outside said tube.

17. The turborefrigerator as set forth in claim 6, wherein said supercooler is installed upstream from said evaporator and supercools the saturated liquid refrigerant by utilizing latent heat of vaporization of a refrigerant having flowed through said throttling mechanism.

18. The turborefrigerator as set forth in claim 6, wherein said supercooler is connected in parallel with said throttling mechanism and supercools the saturated liquid refrigerant by utilizing latent heat of vaporization of a refrigerant having branched off therefrom and flowed through a throttling mechanism of small capacity.

19. The turborefrigerator as set forth in claim 6, which further comprises:

an intercooler having a high-pressure-side throttling mechanism and a low-pressure-side throttling mechanism; and a bypass path for introducing a part of the saturated liquid refrigerant into an upstream side of said low-pressure-side throttling mechanism of said intercooler, wherein said turbocompressor is a multistage turbocompressor, and wherein said supercooler is inserted into said bypass path and supercools the saturated liquid refrigerant by utilizing latent heat of vaporization of an intermediate-pressure refrigerant having branched off therefrom and flowed through a throttling mechanism of small capacity.

20. The turborefrigerator as set forth in claim 6, which further comprises: another small refrigerating cycle from which heat is absorbed in said evaporator, wherein said supercooler is constituted by an evaporator of said small refrigerating cycle.

* * * * *